US006646664B2

(12) United States Patent
Hirano

(10) Patent No.: US 6,646,664 B2
(45) Date of Patent: Nov. 11, 2003

(54) THERMAL TRANSFER SHEET, THERMAL TRANSFER METHOD AND THERMAL TRANSFER SYSTEM

(75) Inventor: Toshifusa Hirano, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/929,941

(22) Filed: Aug. 15, 2001

(65) Prior Publication Data

US 2002/0044192 A1 Apr. 18, 2002

(30) Foreign Application Priority Data

Aug. 24, 2000 (JP) ..... 2000-253618

(51) Int. Cl.[7] ..... B41J 2/315
(52) U.S. Cl. ..... 347/171
(58) Field of Search ..... 347/171, 199, 347/217, 183, 206, 211, 221, 213; 400/241, 241.1; 428/913, 195; 501/227; 503/201

(56) References Cited

U.S. PATENT DOCUMENTS 4,897,669 A * 1/1990 Akutsu et al. ..... 347/199
5,172,131 A * 12/1992 Crystal et al. ..... 347/217
5,298,476 A * 3/1994 Hotta et al. ..... 428/195
5,428,372 A * 6/1995 Akiyama et al. ..... 346/135.1
5,686,382 A * 11/1997 Suzuki et al. ..... 428/195
6,392,680 B2 * 5/2002 Akada et al. ..... 156/230

FOREIGN PATENT DOCUMENTS

EP 0 266 430 A1 * 11/1988 ..... B41M/5/26

* cited by examiner

*Primary Examiner*—Lamson Nguyen
*Assistant Examiner*—K. Feggins
(74) *Attorney, Agent, or Firm*—Ladas & Parry

(57) ABSTRACT

The present invention provides a thermal transfer sheet, a thermal transfer method and a thermal transfer system using thermal transfer sheet. The thermal transfer sheet provided with a coloring layer and the adhesive layer being disposed on the substrate in this order, wherein the adhesive layer is formed of a mixture comprising a copolymerization product (A) obtainable by polymerizing an α-olefin/a maleic acid anhydride copolymer with a maleic acid anhydride monoester and an ethylene/vinyl acetate copolymer (B). The thermal transfer sheet is superior in storage stability in a rolled condition and in printing quality, and also capable of forming a print products having excellent functions as to durability such as wear resistance and heat resistance in high-speed printing.

7 Claims, 1 Drawing Sheet

THERMAL TRANSFER SHEET, THERMAL TRANSFER METHOD AND THERMAL TRANSFER SYSTEM

BACKGROUND OF THE INVENTION

1. Field of the Invention

The present invention relates to a thermal transfer sheet and, particularly, to a thermal transfer sheet which has high sensitivity, is adaptable to high-speed printing and has high abrasive resistance and printing quality.

2. Description of the Related Art

A melting type thermal transfer system has been known, in which an applicable thermal transfer sheet composed of a substrate sheet and a coloring layer which is obtained by dispersing a coloring agent such as a pigment or a dye in a heat-meltable binder such as wax or a resin and supported by the substrate sheet such as a plastic film, and energy corresponding to image information is applied to the thermal transfer sheet by means of a heating device such as a thermal head, and thus the coloring agent is transferred from the thermal transfer sheet to an image-receiving sheet such as paper or a plastic sheet together with the binder. A print image formed by this melting type thermal transfer system has high density and superior sharpness and is therefore suitable for the recording of binary images such as characters and line drawings. In addition, when plural coloring layers such as yellow, magenta, cyan and black are printed and recorded on the image-receiving sheet in a superposed manner with the use of one or more thermal transfer sheets, a multicolor or full color image can be formed by subtractive color mixing.

When images such as a bar code for which strict standards as to line width, intervals between lines and length are established are printed by melting transfer system, it is required for a thermal transfer sheet to be provided with a coloring layer having good film-cuttability and to have sharp printing ability. Also, it is required for a print product to have abrasive resistance in order to enable exact reading by a bar code reader and prevent the print portion from being soiled by rubbing in the handling of the print product. For this, many types of thermal transfer sheet provided with a coloring layer primarily comprising a resin such as an acrylic resin or vinyl acetate type resin have been proposed.

When information such as a bar code is recorded by thermal transfer in a transfer-receiving material by using a thermal transfer sheet of the melting type transfer system, high-speed processing (high-speed printing) is required in many applications. In this case, particularly a thermal transfer printer mounted with a so-called end face type thermal head, specifically, provided with a heat generating resistance part at an end surface of a substrate perpendicular to the plane on which a driver IC for driving is disposed is frequently used.

SUMMARY OF THE INVENTION

However, as the thermal transfer sheet used to attain high-speed processing (high-speed printing) in the above thermal transfer recording, one utilizing a material having high sensitivity is used and a thermal transfer print product prepared using such a thermal transfer sheet provided with a coloring layer made of a highly sensitive resin poses the problem that it is difficult to provide functions as the print product, namely, durability such as wear resistance and heat resistance because the coloring layer such as those which are easily melted and softened at a heating temperature during printing is transferred.

On the other hand, attempts have been made to dispose a peelable layer and the like in combination with the coloring layer on a substrate of a thermal transfer sheet, allowing a print portion to have a multilayer structure to improve the durability, such as wear resistance and heat resistance of the print product. For example, in these attempts, a coloring layer primarily comprising a thermoplastic resin for the purpose of providing the print product with durability such as wear resistance and heat resistance after printing and an adhesive layer using a material having low softening point to provide adaptability to high-speed transfer are disposed on a substrate.

However, in actual, the coloring layer primarily comprising a heat-resistant resin having high softening point has difficulties in conducting thermal energy to the adhesive layer when high-speed printing is carried out by heating from the backface of the thermal transfer sheet. A material having a low softening point and high sensitivity is consequently used for formation of the adhesive layer, which easily causes the so-called blocking phenomenon and background soiling. In the blocking phenomenon, the adhesive layer side of the thermal transfer sheet adheres to the backface side of the substrate of the thermal transfer sheet in the rolled condition during storage. The background soiling is caused by rubbing of the thermal transfer sheet against image-receiving paper during printing.

Accordingly, it is an object of the present invention to solve the aforementioned problems by providing a thermal transfer sheet which is superior in storage stability in a rolled condition and in printing quality, and also capable of forming a print products having excellent functions as to durability such as wear resistance and heat resistance in high-speed printing.

In order to attain the above object, a thermal transfer sheet according to the present invention comprises a substrate, a coloring layer and an adhesive layer, the coloring layer and the adhesive layer being disposed on one side of the substrate in this order from a side near the substrate, wherein the adhesive layer is formed of a mixture comprising a polymerization product (A) obtainable by polymerizing an $\alpha$-olefin/a maleic acid anhydride copolymer with a maleic acid anhydride monoester and an ethylene/vinyl acetate copolymer (B).

Since the above polymerization product A is contained in the adhesive layer, particularly blocking during storage in a rolled condition can be prevented. Also, since the above copolymer B is contained in the adhesive layer, the thermal transfer sheet has high printing quality in, particularly, high-speed printing.

Further, since the copolymerization product A and the copolymer B are blended to form the adhesive layer, a thermal transfer sheet which is superior in storage stability in a rolled condition and in printing quality, and also capable of forming a print products having excellent functions as to durability such as wear resistance and heat resistance in high-speed printing and is well-balanced between various qualities can be provided.

Preferably said adhesive layer further comprises a polyethylene resin filler (C). Blending of the polyethylene resin filler (C) further improves transfer characteristics in high-speed printing.

A peelable layer comprising wax as its major component is preferably disposed between said coloring layer and said substrate. The wax melts during thermal transfer and improves the peelability of the coloring layer from the substrate and after transferred, at least a part thereof is transferred together with the coloring layer to cover the transferred image, and it imparts good lubricity to a protective layer of the coloring layer or particularly the transferred image, whereby the abrasive resistance of the transferred image can be more improved.

The thermal transfer sheet of the present invention is preferably used in a printing system using a thermal transfer printer provided with an end face type thermal head. This makes it possible to carry out thermal transfer recording in high-speed printing.

DETAILED DESCRIPTION OF THE PREFERRED EMBODIMENT

Figure 1:
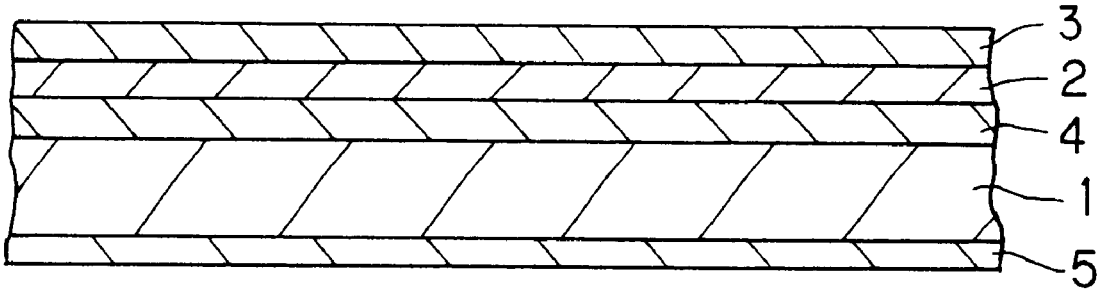
FIG. 1 is a schematically sectional view showing an example of a thermal transfer sheet according to the present invention.

Next, an embodiment according to the present invention will be explained in detail. The fundamental form of a thermal transfer sheet according to the present invention is a structure in which at least a coloring layer 2 and an adhesive layer 3 are disposed in this order on one surface of a substrate 1 as shown in FIG. 1. A peelable layer 4 may be disposed between the coloring layer and the substrate and also, a heat resistant layer 5 may be disposed on the other surface of the substrate.

Each layer constituting the thermal transfer sheet of the present invention will be hereinafter explained in detail.

(Substrate)

As the substrate used for the thermal transfer sheet of the present invention, not only the same substrate as those used for the conventional thermal transfer sheet may be used as it is but also other substrates may be used and there is no particular limitation to the type of substrate. Specific examples preferably used as the substrate include films of plastics such as a polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated rubber and ionomer; papers such as condenser paper and paraffin paper; and nonwoven fabric. Composite substrates obtainable by laminating these substrates may also be used. A particularly preferable substrate is a polyethylene terephthalate film. The thickness of the substrate is preferably, for example, about 2 to 10 $\mu$m though it may be changed corresponding to the type of material to obtain proper strength and heat conductivity.

(Coloring layer)

The coloring layer of the thermal transfer sheet of the present invention is obtained in the following manner. Specifically, a coating solution prepared by dissolving or dispersing at least a coloring agent and a binder in a solvent and by further adding additives such as a plasticizer, surfactant, lubricant and fluidity regulator as occasion demand is applied to the substrate in an amount of about 0.1 to 5 g/m$^2$ and preferably about 0.3 to 1.5 g/m$^2$ in a dry state by a conventionally known method such as hotmelt coating, hot lacquer coating, gravure direct coating, gravure reverse coating, knife coating, air coating or roll coating.

When the amount of a dry coating film is less than 0.1 g/m$^2$, a uniform ink layer cannot be obtained on account of a problem concerning film forming property. Also, when the coating amount exceeds 5 g/m$^2$, high energy is required when printing and transfer operations are carried out, giving rise to the problem that printing can be made only by means of a special thermal transfer printer.

For the coloring agent, each coloring agent such as yellow, magenta, cyan, black or white color maybe optionally selected from conventionally known dyes and pigments.

The binder to be used for the coloring layer preferably constituted primarily of a resin. Specific examples of the resin include cellulose type resins, melamine type resins, polyester type resins, polyamide type resins, polyolefin type resins, acrylic resins, styrene type resins, vinyl chloride/vinyl acetate copolymers and thermoplastic elastomers such as styrene-butadiene rubber. Among these resins used for the binder, polyester type resins, acrylic resins and vinyl chloride/vinyl acetate copolymers are preferably used in view of, particularly, transferability, abrasive resistance and heat resistance. In addition, a wax component may be used by mixing it with the resin as far as the heat resistance and the like are not impaired.

Examples of the waxes include microcrystalline wax, carnauba wax and paraffin wax. Further, various waxes such as Fisher-Tropsch wax, various low molecular polyethylenes, haze wax, beeswax, spermaceti wax, insect wax, wool wax, shellac wax, candelilla wax, petrolatum, polyester wax, partially denatured wax, fatty acid ester and fatty acid amide are exemplified. Among these waxes, particularly those having a melting point of 50 to 85° C. are preferable. When the melting point is less than 50° C., a storage problem arises whereas when the melting point exceeds 85° C., inferior printing sensitivity is obtained.

The aforementioned coloring layer is preferably formed using an ink composition comprising the coloring agent in a range of 20 to 70% by weight and the binder in a range of 80 to 30% by weight. When the proportion of the coloring agent is smaller than the above range, the coating amount of the coloring agent must be increased to obtain a sufficient color density, bringing about insufficient printing sensitivity. On the other hand, when the proportion of the coloring agent is greater than the above range, no film formability is obtained, causing reduced abrasive resistance after printing is finished.

(Adhesive Layer)

The thermal transfer sheet of the present invention composed by disposing at least the coloring layer and the adhesive layer on one surface of the substrate, and the adhesive layer contains at least a mixture of a copolymerization product (A) obtainable by copolymerizing an $\alpha$-olefin/a maleic acid anhydride copolymer with a maleic acid anhydride monoester and an ethylene/vinyl acetate copolymer (B).

The aforementioned copolymerization product (A) is a copolymer obtainable by copolymerizing an $\alpha$-olefin/a maleic acid anhydride copolymer as a first unit and a maleic acid anhydride monoester as a second unit. It is available as a commercial product, for example Ceramer series manufactured by Petrolite Corporation. Among the Ceramer series, for example Ceramer 1608 is a copolymerization product of "a copolymer of an $\alpha$-olefin and maleic acid anhydride" and "a maleic acid anhydride monoisopropylester" and is preferably used.

The above copolymerization product A has a melting point of about 60 to 80° C. and serves to suppress the occurrence of blocking between the adhesive layer and the substrate backface side while the thermal transfer sheet is stored mainly in a coiled state to secure the fixing ability of the coloring layer to image-receiving sheet during thermal transfer. Also, the aforementioned copolymerization product A has the characteristics difficult of deterioration in transferability to a transfer-receiving material in high-speed printing.

The ethylene/vinyl acetate copolymer B to be contained in the adhesive layer is a copolymer obtainable by copolymerizing ethylene with vinyl acetate. Among the copolymer B, one having a melting point of about 50 to 70° C., containing a vinyl acetate component in a ratio (VA) by weight of about 19 to 33% and having a melt index (MI) of about 5 to 400 is preferably used. Blending of the copolymer B into the adhesive layer can compensate for and improve defects in the system using only the aforementioned copolymerization product A that no highly sensitive transferability corresponding to high-speed printing is hardly obtained.

The mixing ratio (by weight) of the above copolymerization product A to the above copolymer B is about ⅓ to 3/1 in terms of ratio of the copolymerization product A/the copolymer B.

It is preferable to make the adhesive layer further contain a polyethylene resin filler C together with the mixture of the above copolymerization product A and the copolymer B. The addition of the polyethylene resin filler C effects improvements in the prevention of blocking during storage in a coiled state and in transferability in high-speed printing.

The polyethylene resin filler C includes homo- and co-polymers containing ethylene as a monomer unit. As a preferable polyethylene resin filler C, one containing ethylene groups in a high ratio selected from the group consisting of polyethylene homopolymer, ethylene/vinyl acetate copolymer, ethylene/acrylic acid copolymer, ethylene/methacrylic acid copolymer, ethylene/ethyl acrylate copolymer, and ethylene/methacrylate copolymer. These preferable polyethylene resin filler C have low solubility in an organic solvent and can be made to exist in a particle state in a coating solution for the adhesive layer, whereby adaptability to high-speed printing can be improved.

Although the reason why the above effects are produced is not clarified, it is considered that a grip on image-receiving sheet during high-speed printing is increased by blending of the polyethylene resin filler C and the image-receiving sheet is thereby firmly bonded to the thermal transfer sheet with the result that the cohesive force of the adhesive layer in the initial stage is decreased.

As the aforementioned polyethylene filler C, the use of an ethylene copolymer particle is more preferable than that of a resin particle of polyethylene homopolymer resin in view of printing sensitivity.

As the polyethylene resin filler C, those containing an average particle diameter of about 0.3 to 10 $\mu$m are preferable and the resin filler C is preferably added in an amount of about 2 to 30% by weight based on the binder contained in the adhesive layer. If the amount of the resin filler C is excessively small, the above effect can be produced insufficiently whereas if the amount is excessively large, printing qualities are decreased and therefore an amount out of the above range is undesirable.

The adhesive layer is produced in the following manner. Specifically, the above copolymerization product A, the above copolymer B and, optionally, the above polyethylene resin filler C and the other components such as thermoplastic resins, wax and additives are dissolved or dispersed in a proper organic solvent or water to prepare a coating solution for forming an adhesive layer. The coating solution is then applied by a conventionally known common coating means such as a gravure coater, roll coater or wire bar, followed by drying.

The adhesive layer is applied in an amount of about 0.05 to 5 g/m$^2$ in a dry state in general. When the amount of the dry coating film is less than 0.05 g/m$^2$, adhesion between the image-receiving sheet and the coloring layer is inferior, causing transfer inferior during printing. On the other hand, when the coating amount exceeds 5 g/m$^2$, transfer sensitivity during printing is reduced and therefore no satisfactory printing quality can be obtained.

(Peelable Layer)

The peelable layer to be formed on one surface of the above substrate melts during thermal transfer and improves the peelability of the coloring layer from the substrate and after transferred, at least a part thereof is transferred together with the coloring layer to cover the transferred coloring layer, imparting good lubricity to a protective layer of the coloring layer, particularly the transferred image to improve the abrasive resistance of the transferred image. As a material forming the peelable layer, various resin and waxes having highly peelable ability may be used, and the materials include acrylic resins, silicone resins, fluororesins or various resins modified by silicone or fluorine. It is preferable to use wax as a major component.

As this wax, various waxes which melt during printing to exhibit high peelability are preferable. Examples of the wax which is preferably used include various waxes such as microcrystalline wax, carnauba wax, paraffin wax, Fisher-Tropsch wax, various low molecular polyethylenes, haze wax, beeswax, spermaceti wax, insect wax, wool wax, shellac wax, candelilla wax, petrolatum, partially denatured wax, fatty acid ester and fatty acid amide. Among these waxes, particularly preferable wax is microcrystalline wax or carnauba wax which has a relatively high melting point and is hardly soluble in a solvent.

The aforementioned peelable layer is preferably made into a thin layer with, for example, a thickness of about 0.1 to 2 g/m$^2$ in a dry state so as to prevent the sensitivity of the thermal transfer sheet from decreasing.

(Heat Resistant Layer)

In the present invention, a heat resistant layer which improves the lubricity of a thermal head and prevents sticking is preferably disposed on the surface which is in contact with a thermal head, namely on the side opposite to the side of the substrate on which side the coloring layer is disposed when, for example, a material which is low in heat tolerance is used as the substrate. The heat resistant layer is fundamentally composed of a heat resistant resin and a material functioning as a thermal releasing agent or a lubricant. The provision of such a heat resistant layer ensures that thermal transfer printing can be carried out without sticking even in the case of a thermal transfer sheet using a material which has a low degree of heat tolerance as the substrate, exhibiting the merits of the plastic film such as resistance to cutting and high processability.

This heat resistant layer is formed by appropriately using a composition obtained by adding a lubricant, surfactant, inorganic particle, organic particle, pigment and the like to a binder resin. Examples of the binder resin to be used for the heat resistant layer include cellulose type resins such as ethyl cellulose, hydroxyethyl cellulose, hydroxypropyl cellulose, methyl cellulose, cellulose acetate, cellulose acetate butyrate and cellulose nitrate; vinyl type resins such as polyvinyl alcohol, polyvinyl acetate, polyvinylbutyral, polyvinylacetal, polyvinylpyrrolidone, acrylic resins, polyacrylamide, and acrylonitrile/styrene copolymers; polyester resins; polyurethane resins; and silicone-modified or fluorine-modified urethane resins.

Among these resins, those having several reactive groups, for example, hydroxyl groups are preferably used as the crosslinkable resin by combination use with a polyisocyanate as a crosslinking agent. As to a method forming the heat resistant layer, a material prepared by adding a lubricant, surfactant, inorganic particle, organic particle, pigment and the like to the binder resin as aforementioned is dissolved or dispersed in a proper solvent to prepare a coating solution, which is then applied using a common coating means such as a gravure coater, roll coater or wire bar, followed by drying.

EXAMPLES

Next, the present invention will be explained in more detail by way of examples, in which all designations of parts and % are expressed on weight basis, unless otherwise noted.

Example 1

As the substrate, a polyethylene terephthalate film (Lumirror, manufactured by Toray Industries. Inc.) with a thickness of 4.5 $\mu$m was used. A coating solution having the following composition for a heat resistant layer was applied to one surface of the above substrate in advance by gravure coating in a dry coating amount of 0.1 g/m$^2$ and dried to form a heat resistant layer.

Next, a coating solution having the following composition for a peelable layer was applied to the other surface of the above substrate by gravure coating in a dry coating amount of 0.6 g/m$^2$ and dried to form a peelable layer. Further, a coating solution having the following composition for a coloring layer was applied to the peelable layer by gravure coating in a dry coating amount of 0.6 g/m$^2$ and dried to form a coloring layer. Further, a coating solution having the following composition for an adhesive layer was applied to the coloring layer by gravure coating in a dry coating amount of 0.6 g/m$^2$ and dried to form an adhesive layer, thereby producing a thermal transfer sheet of Example 1.

| | |
|---|---|
| <Coating solution for a peelable layer> | |
| Carnauba wax emulsion (manufactured by Konishi Co., Ltd., solid content: 40%) : | 100 parts |
| Water: | 100 parts |
| Isopropyl alcohol: | 100 parts |
| <Coating solution for a coloring layer> | |
| Carbon black: | 30 parts |
| Polymethylmethacrylate (BR83, manufactured by Mitsubishi Rayon Co., Ltd.): | 50 parts |
| Candelilla wax: | 20 parts |
| Toluene: | 200 parts |
| Methyl ethyl ketone: | 200 parts |
| <Coating solution for an adhesive layer> | |
| Ethylene/vinyl acetate copolymer (VA = 28%, MI = 15): | 40 parts |
| Copolymer product of α-olefin/maleic acid anhydride copolymer and maleic acid anhydride monoisopropylester (Ceramer 1608, manufactured by Petrolite Corporation): | 35 parts |
| Aromatic, petroleum resin (Neopolymer 160, manufactured by Nippon Petrochemical): | 25 parts |
| Methyl ethyl ketone: | 120 parts |
| Cyclohexane: | 310 parts |
| Toluene: | 270 parts |
| <Coating solution for a heat resistant layer> | |
| Styrene/acrylonitrile copolymer: | 11 parts |
| Linear saturated polyester resin: | 0.5 parts |
| Zinc stearyl phosphate: | 5 parts |
| Urea resin powder: | 5 parts |
| Melamine resin powder: | 3 parts |
| Toluene: | 40 parts |
| Methyl ethyl ketone: | 40 parts |

Example 2

A thermal transfer sheet of Example 2 was produced in the same manner as in Example 1 except that the composition of the coating solution for an adhesive layer in the thermal transfer sheet of the above Example 1 was altered to the following composition.

| | |
|---|---|
| <Coating solution for an adhesive layer> | |
| Ethylene/vinyl acetate copolymer (VA = 28%, MI = 15): | 40 parts |
| Copolymer product of α-olefin/maleic acid anhydride copolymer and maleic acid anhydride monoisopropylester (Ceramer, 1608, manufactured by Petrolite Corporation): | 20 parts |
| Aromatic petroleum resin (Neopolymer 160, manufactured by Nippon Petrochemical): | 25 parts |
| Ethylene/vinyl acetate copolymer dispersion (VA = 8%, MI = 25): | 15 parts |
| Methyl ethyl ketone: | 120 parts |
| Cyclohexane: | 310 parts |
| Toluene: | 270 parts |

Example 3

A thermal transfer sheet of Example 3 was produced in the same manner as in Example 2 except that the composition of the coating solution for a coloring layer in the thermal transfer sheet produced in the above Example 2 was altered to the following composition.

| | |
|---|---|
| <Coating solution for a coloring layer> | |
| Carbon black: | 30 parts |
| Vinyl chloride/vinyl acetate copolymer (VYHH, manufactured by Union Carbide): | 60 parts |
| Carnauba wax dispersion: | 10 parts |
| Toluene: | 200 parts |
| Methyl ethyl ketone: | 200 parts |

Comparative Example 1

A thermal transfer sheet of Comparative Example 1 was produced in the same manner as in Example 1 except that the composition of the coating solution for an adhesive layer in the thermal transfer sheet produced in the above Example 1 was altered to the following composition.

| | |
|---|---|
| <Coating solution for an adhesive layer> | |
| Ethylene/vinyl acetate copolymer (VA = 28%, MI = 15): | 40 parts |
| α-olefin/maleic acid anhydride copolymer (Diacarna 30, manufactured by Mitsubishi Chemical Corporation): | 35 parts |
| Aromatic petroleum resin (Neopolymer 160, manufactured by Nippon Petrochemical): | 25 parts |
| Methyl ethyl ketone: | 120 parts |
| Cyclohexane: | 310 parts |
| Toluene: | 270 parts |

Comparative Example 2

A thermal transfer sheet of Comparative Example 2 was produced in the same manner as in Example 1 except that the composition of the coating solution for an adhesive layer in the thermal transfer sheet produced in the above Example 1 was altered to the following composition.

| <Coating solution for an adhesive layer> | |
|---|---|
| Ethylene/vinyl acetate copolymer (VA = 28%, MI = 15): | 40 parts |
| Ethylene/vinyl acetate copolymer (VA = 28%, MI = 300): | 35 parts |
| Aromatic petroleum resin (Neopolymer 160, manufactured by Nippon Petrochemical): | 25 parts |
| Methyl ethyl ketone: | 120 parts |
| Cyclohexane: | 310 parts |
| Toluene: | 270 parts |

Comparative Example 3

A thermal transfer sheet of Comparative Example 3 was produced in the same manner as in Example 1 except that the compositions of the coating solutions for a coloring layer and an adhesive layer in the thermal transfer sheet produced in the above Example 1 was altered to the following compositions respectively.

| <Coating solution for a coloring layer> | |
|---|---|
| Carbon black: | 30 parts |
| Ethylene/vinyl acetate copolymer (VA = 28%, MI = 7.5): | 50 parts |
| Candelilla wax: | 20 parts |
| Toluene: | 385 parts |
| Methyl ethyl ketone: | 15 parts |
| <Coating solution for an adhesive layer> | |
| Ethylene/vinyl acetate copolymer (VA = 28%, MI = 15): | 40 parts |
| α-olefin/maleic acid anhydride copolymer (Diacarna 30, manufactured by Mitsubishi Chemical Corporation): | 35 parts |
| Aromatic petroleum resin (Neopolymer 160, manufactured by Nippon Petrochemical): | 25 parts |
| Methyl ethyl ketone: | 120 parts |
| Cyclohexane: | 310 parts |
| Toluene: | 270 parts |

(Test)

Using the thermal transfer sheets of the above Examples and Comparative Examples, printing was carried out in the following printing condition and the print products were evaluated for adaptability to high-speed printing, durability, heat resistance, resistance to alcohol and background soiling according to the following evaluation method. Further, each thermal transfer sheet was wound as a roll to evaluate for blocking resistance.

<Printing Condition>

As a printer, TTX450 (mounted with an end type thermal head) manufactured by AVERY DENNISON was used and a bar code pattern was printed on mirror coated paper at a printing speed of 10 inch/sec.

<Evaluation of Adaptability to High-Speed Printing>

The state of the transferred bar code in the print product obtained in the above printing condition was visually observed to evaluate the state according to the following decision criteria.

Criteria:

◎: Transfer of the bar code is very well.

○: Transfer of the bar code is well.

Δ: Transfer of the bar code is partially inferior.

×: Transfer of the bar code is inferior overall.

<Evaluation of Durability>

In each of the above print products, the print portion was rubbed using the following method and the state of the rubbed surface of the print product was visually observed to evaluate the durability according to the following decision criteria.

Rubbing Test:

Tester: Wear tester manufactured by Suga Test Instruments Co., Ltd.

Load: 500 g

Moving speed: 30 mm/sec

Number of reciprocating: 100 times

Applied cloth: Shirting No. 3

Criteria:

◎: Falling of the print portion is not observed at all and soiling of the background is not observed at all.

○: Falling of the print portion is not almost observed but soiling of the background is observed a little.

Δ: Falling of the print portion is observed a little and soiling of the background is observed.

×: Falling of the print portion is significant and remarkable soiling of the background is observed.

<Evaluation of Heat Resistance>

With regard to each of the above print products, the print portion of the print product was heated and pressed in the condition that the print portion is in contact with an applied cloth and state of the face condition of the print product was visually observed to evaluate the heat resistance according to the following criteria.

Test Method:

Tester: TP-701S, manufactured by Heat Seal Tester Industries

Pressure: 3.5 kg/cm$^2$

Temperature: 180° C.

Time: 10 sec

Applied cloth: Shirting No. 3

Criteria:

◎: Falling of the print portion is not observed at all and any change is not observed at all.

○: Falling of the print portion is not almost observed and almost no change is observed.

Δ: Falling of the print portion is observed a little and a little change is observed.

×: Falling of the print portion is significant and a remarkable change is observed.

<Evaluation of Resistance to Alcohol>

With regard to each of the above print products, the print portion was rubbed with an applied cloth impregnated with a solvent by the following method and state of the rubbed surface of the print product was visually observed to evaluate the resistance to alcohol according to the following criteria.

Rubbing Test:

Tester: Wear tester manufactured by Suga Test Instruments Co., Ltd.

Load: 1 kg

Moving speed: 30 mm/sec

Number of reciprocating: 20 times

Applied cloth: Shirting No. 3

Solvent: Denatured ethanol

Criteria:

◎: The print portion can be read and is not soiled so much.

Δ: The print portion can be read but is soiled.

×: The print portion cannot be read and soiled significantly.

<Evaluation of Background Soiling>

In the print product obtained in the aforementioned printing condition, the state of the soiling of the non-printed portion was visually observed to evaluate the background soiling according to the following criteria.

Criteria:

○: Soiling of the non-printed portion is not almost observed.

×: Soiling of the non-printed portion is remarkable.

<Evaluation of Blocking Resistance>

Next, each thermal transfer sheet produced above was examined in its blocking resistance in the following condition to evaluate according the following criteria.

Each sample was wound as a roll with a length of 240 m, stored for 2 days under 50° C. and 85% RH, and then rolled back to examine the sample in the condition as to the generation of blocking. That is, state of the both surfaces of the thermal transfer sheet including a side on which the adhesive layer was formed and the opposite side thereto were visually observed to examine whether foreign substances were stuck or not and also to examine whether the layer was fallen off or not. The evaluation of the sample was made according to the following criteria.

Criteria:

○: No blocking was observed, exhibiting high blocking resistance.

×: Blocking was observed, exhibiting inferior blocking resistance.

(Result of Evaluation)

The results of the evaluation of the above Examples and Comparative Examples are shown in Table 1.

TABLE 1

| | Adaptability to high-speed printing | Durability | Heat resistance | Resistance to alcohol | Background soiling | Blocking resistance |
|---|---|---|---|---|---|---|
| Example 1 | ○ | ◎ | ◎ | Δ | ○ | ○ |
| Example 2 | ◎ | ◎ | ◎ | Δ | ○ | ○ |
| Example 3 | ◎ | ○ | Δ | ○ | ○ | ○ |
| Comparative example 1 | x | — | — | — | ○ | ○ |
| Comparative example 2 | Δ | ◎ | ◎ | Δ | x | x |
| Comparative example 3 | ○ | Δ | x | x | ○ | ○ |

As stated above, the thermal transfer sheet according to the present invention comprises a substrate, a coloring layer and an adhesive layer, the coloring layer and the adhesive layer being disposed on one side of the substrate, wherein the adhesive layer is formed of a mixture comprising a polymerization product (A) obtainable by copolymerizing an α-olefin/a maleic acid anhydride copolymer with a maleic acid anhydride monoester copolymer and an ethylene/vinyl acetate copolymer (B). Since the above polymerization product A is contained in the adhesive layer, a blocking phenomenon of the thermal transfer sheet during storage in a rolled condition can particularly be prevented. Also, since the above copolymer B is contained in the adhesive layer, the thermal transfer sheet has high printing quality in, particularly, high-speed printing.

Further, since the copolymerization product A and the copolymer B are blended to form the adhesive layer, a thermal transfer sheet which is superior in storage stability in a rolled condition and in printing quality, and also capable of forming a print products having excellent functions as to durability such as wear resistance and heat resistance in high-speed printing and is well-balanced between various qualities can be provided.

Preferably said adhesive layer further comprises a polyethylene resin filler (C). Blending of the polyethylene resin filler (C) further improves transfer characteristics in high-speed printing.

What is claimed is:

1. A thermal transfer sheet comprising a substrate, a coloring layer including a heat meltable ink, and an adhesive layer, the coloring layer and the adhesive layer being disposed on one side of the substrate in this order from a side near the substrate, wherein the adhesive layer is farmed of a mixture comprising a copolymerization product (A) obtainable by polymerizing an α-olefin/a inside acid anhydride copolymer with a maleic acid anhydride monoester and an ethylene/vinyl acetate copolymer (B).

2. A thermal transfer sheet according to claim 1 wherein said copolymerization product (A) has a melting point in a range of 60 to 80° C. and said copolymer (B) has a melt index paint in a range of 5 to 400° C.

3. A thermal transfer sheet according to claim 1, wherein said copolymerization product (A) and said copolymer (B) are mixed in a ratio of 1/3 to 3/1 in terms of ratio by weight of the copolymerization product (A)/the copolymer (B).

4. A thermal transfer sheet according to claim 1, wherein said adhesive layer further comprises a polyethylene resin filler (C).

5. A thermal transfer sheet according to claim 1, wherein a peelable layer containing wax as its major component is further disposed between said coloring layer and said substrate.

6 A thermal transfer method comprising the steps of: providing a thermal transfer sheet comprising a substrate, a coloring laye including a heat meltable ink, and an adhesive layer, the coloring, layer and the adhesive layer being disposed on one side of the substrate in this order from a side near the substrate, wherein the adhesive layer is formed of a mixture comprising a copolymerization product (A) obtainable copolymerizing an α-olefin/a maleic acid anhydride copolymer with a maleic acid anhydride monoester and an ethylene/vinyl acetate copolymer (B), end carrying out the printing by heating the thermal transfer sheet by means of a thermal transfer printer having an end face type thermal head.

7. A thermal transfer system comprising: A thermal transfer sheet comprising a substrate, a coloring layer and an adhesive layer, the coloring layer including a treat meltable ink, and the adhesive layer being disposed on one side of the substrate in this order from a side near the substrate, wherein the adhesive layer is formed of a mixture comprising a copolymerization product (A) obtainable by polymerizing an α-olefin/a maleic acid anhydride copolymer with a maleic acid anhydride monoester and an ethylene/vinyl acetate copolymer (B), and a thermal transfer printer having an end face type thermal head for heating the thermal transfer sheet according to the image information.

* * * * *